US007497731B2

(12) United States Patent
Rosenfeldt et al.

(10) Patent No.: US 7,497,731 B2
(45) Date of Patent: Mar. 3, 2009

(54) CONNECTOR SYSTEM

(75) Inventors: Bernd Rosenfeldt, Hamilton, MA (US); Clifford Richer-Kelly, Well, ME (US)

(73) Assignee: Draeger Medical Systems, Inc., Andover, MA (US)

( * ) Notice: Subject to any disclaimer, the term of this patent is extended or adjusted under 35 U.S.C. 154(b) by 0 days.

(21) Appl. No.: 11/562,737

(22) Filed: Nov. 22, 2006

(65) Prior Publication Data

US 2007/0123065 A1 May 31, 2007

Related U.S. Application Data

(60) Provisional application No. 60/739,306, filed on Nov. 23, 2005.

(51) Int. Cl.
*H01R 13/648* (2006.01)

(52) U.S. Cl. ..... 439/607

(58) Field of Classification Search ..... 439/620, 439/181, 260, 630, 607
See application file for complete search history.

(56) References Cited

U.S. PATENT DOCUMENTS 5,083,945 A * 1/1992 Miskin et al. ..... 439/607
5,125,854 A 6/1992 Bassler et al.
5,565,654 A * 10/1996 Zell et al. ..... 439/75
5,582,180 A * 12/1996 Manset et al. ..... 600/508
5,618,208 A * 4/1997 Crouse et al. ..... 439/609
5,890,929 A 4/1999 Mills et al.
6,010,371 A * 1/2000 Farley et al. ..... 439/676
6,053,771 A * 4/2000 Hood et al. ..... 439/607
6,193,655 B1 * 2/2001 McGrath ..... 600/301
6,541,711 B1 * 4/2003 Dube et al. ..... 174/261
6,623,306 B2 * 9/2003 Xu et al. ..... 439/676
6,721,936 B2 * 4/2004 Bobba et al. ..... 257/678
6,953,351 B2 * 10/2005 Fromm et al. ..... 439/101
2001/0055901 A1 12/2001 Kato et al.
2002/0094710 A1 7/2002 Otremba et al.
2002/0142633 A1 10/2002 Inagawa
2003/0027447 A1 2/2003 Cooper et al.
2003/0032313 A1 2/2003 Kojima et al.
2003/0054683 A1 3/2003 Bryan et al.
2003/0064614 A1 4/2003 Tanaka et al.
2003/0109177 A1 6/2003 Meredith
2003/0129865 A1 7/2003 Kato et al.
2004/0192092 A1 9/2004 Borrego Bel et al.
2005/0227515 A1 10/2005 Hsu

FOREIGN PATENT DOCUMENTS

EP 0928049 A2 7/1999
WO WO 01/47262 6/2001

* cited by examiner

*Primary Examiner*—Briggitte R Hammond
(74) *Attorney, Agent, or Firm*—Rissman Jobse Hendricks & Oliverio, LLP

(57) ABSTRACT

A connector system conveys signals supporting patient medical parameter data acquisition and includes a connector body supporting a plurality of clusters of pins, e.g. at least first, second and third clusters. An individual cluster includes a plurality of pins. The first, second and third clusters are mutually isolated by a minimum electrical creepage distance. The connector body supports mating with a corresponding connector attached to an electrical cable. The connector system also includes a metal connector housing for at least partially electrically shielding the plurality of clusters of pins and is electrically connected to a shield potential.

13 Claims, 5 Drawing Sheets

CONNECTOR SYSTEM

The present application claims priority from provisional application Ser. No. 60/739,306 filed Nov. 23, 2005.

FIELD OF THE INVENTION

The present invention relates to connector systems and in particular to connector systems for conveying signals supporting patient medical parameter data acquisition.

BACKGROUND OF THE INVENTION

In existing patient care systems, a standard personal computer (PC) (or other processing device) is typically interconnected with one or more medical devices. Such a PC typically needs to be rebuilt, or fabricated specially, so that the PC has electrical isolation at input and output connectors required in patient monitoring and/or therapy environments. In particular, four aspects of such electrical isolation are of importance.

Ground Integrity

When a patient is concurrently connected to more than one patient medical monitoring and/or therapy devices that are interconnected, and the medical monitoring and/or therapy devices are in conductive (e.g. metallic) housings or chassis, care needs to be taken that a difference in ground potential between the device enclosures does not cause current to flow through the patient in the accidental case that a patient touches or by some means comes concurrently into contact with both enclosures. For this reason electrical isolation is maintained between medical devices when concurrently connected to a patient.

Isolation of a device may be accomplished in one of different ways if the device has exposed metal parts. These ways include, for example:

1. The device housing is electrically isolated from the device electronics and individual input and output connectors are electrically isolated from the chassis ground connections; or
2. Power into the device is isolated from the exposed conductive part of the medical monitoring and/or therapy device, allowing the device chassis and input and output ports to float to one common potential.

If the second method is used, the exposed housing of a medical device needs to satisfy a ground integrity test with respect to exposed housings of other interconnected medical devices in the system. Standards specify a limit of 200 milliohms (mohms) resistance between medical devices for such connections.

Power Sequencing

When "hot" plugging two connectors, i.e. plugging when the medical device is powered-on, it is desirable not to plug a pin coupled to a heavy electrical load into a socket which providing significant power or a spark may occur when plugging the connectors together. The spark may be small such as an ESD spark which has very high voltage but very little power behind it. In a powered system, however, a spark may occur even with a relatively low voltage if the power is large enough. In either case, a spark may be catastrophic in a patient environment which may include oxygen or other flammable or explosive gases or other materials.

Mechanical Latching

In order to ensure that the different medical monitoring and/or treatment devices do not accidentally become disconnected, once they are connected, connectors generally include mechanical latching. This prevents a potential difference from accidentally occurring between housings of two different medical devices concurrently connected to the patient. This also can prevent a spark from accidentally occurring when pins carrying power are separated.

Creepage Distance

Creepage refers to the conduction of electricity along the surface of a dielectric, and creepage distance is the shortest distance over the surface of an intervening dielectric between two conductors. Minimizing creepage reduces the resistance between conductors in a connector. One way to minimize creepage is to increase creepage distance between conductors in a connector.

Typically, providing the above electrical isolation requires a custom-built PC with electrical isolation built into each connector port and represents a complex and expensive implementation. A system according to invention principles addresses these needs and associated problems.

BRIEF SUMMARY OF THE INVENTION

In accordance with principles of the present invention, a connector system conveys signals supporting patient medical parameter data acquisition and includes a connector body supporting a plurality of clusters of pins, e.g. at least first and second clusters. An individual cluster includes a plurality of pins. The first and second clusters are isolated by a minimum electrical creepage distance. The connector body supports mating with a corresponding connector attached to an electrical cable. The connector system also includes a metal connector housing for at least partially electrically shielding the plurality of clusters of pins and is electrically connected to a shield potential.

A cable system according principles of the present invention connects "intelligent nodes", that is, nodes which have a processor and computing power associated with them, to form a network of medical equipment that needs to connect and disconnect while maintaining predetermined standards of electrical isolation for medical safety, as described in more detail below. The system advantageously simplifies design and lowers cost.

DETAILED DESCRIPTION OF THE INVENTION

Figure 1A:
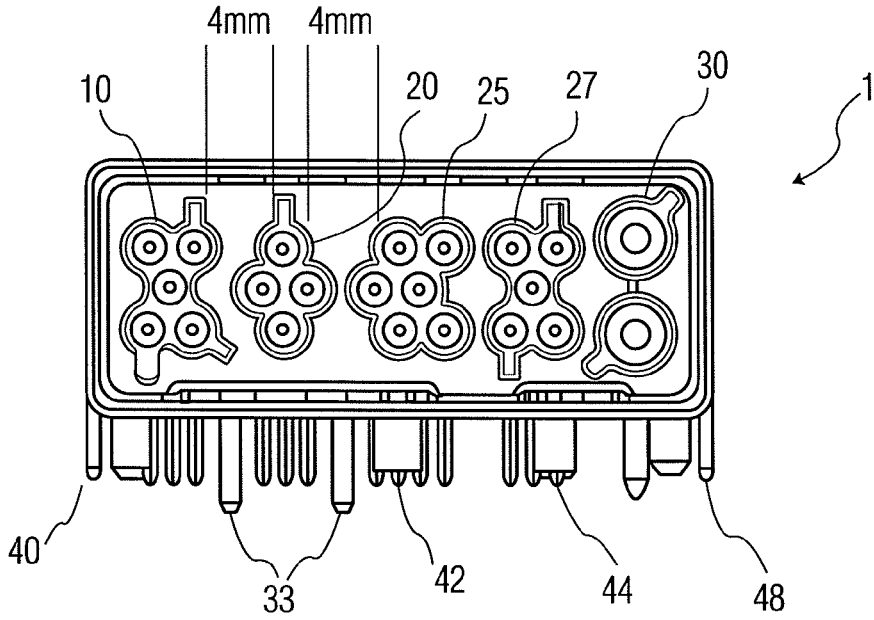
FIG. 1*a* is a front view.

A processor, as used herein, operates under the control of an executable application to (a) receive information from an input information device, (b) process the information by manipulating, analyzing, modifying, converting and/or transmitting the information, and/or (c) route the information to an output information device. A processor may use, or comprise the capabilities of, a controller or microprocessor, for example. The processor may operate with a display processor or generator. A display processor or generator is a known element for generating signals representing display images or portions thereof. A processor and a display processor comprises any combination of, hardware, firmware, and/or software.

An executable application, as used herein, comprises code or machine readable instructions for conditioning the processor to implement predetermined functions, such as those of an operating system, patient medical parameter data acquisition system or other information processing system, for example, in response to user command or input. An executable procedure is a segment of code or machine readable instruction, sub-routine, or other distinct section of code or portion of an executable application for performing one or more particular processes. These processes may include receiving input data and/or parameters, performing operations on received input data and/or performing functions in response to received input parameters, and providing resulting output data and/or parameters.

A user interface (UI), as used herein, comprises one or more display images, generated by the display processor under the control of the processor. The UI also includes an executable procedure or executable application. The executable procedure or executable application conditions the display processor to generate signals representing the UI display images. These signals are supplied to a display device which displays the image for viewing by the user. The executable procedure or executable application further receives signals from user input devices, such as a keyboard, mouse, light pen, touch screen or any other means allowing a user to provide data to the processor. The processor, under control of the executable procedure or executable application manipulates the UI display images in response to the signals received from the input devices. In this way, the user interacts with the display image using the input devices, enabling user interaction with the processor or other device.

The connector system according to the present invention incorporates the following functions, described above, in a small space:

1. Ground Integrity Design and shielding.
2. Power sequencing
3. Mechanical latching
4. Creepage distance techniques.

By combining these functions in a small connector system, complex medical devices may be connected together while maintaining safety standards.

Ground Integrity

As described above, standards require that exposed surfaces of interconnected medical monitoring and/or therapy devices maintain a ground integrity limit of less than 200 mohms resistance between such devices. According to the present invention, a plug connects a data cable to a corresponding socket on respective medical monitoring and/or therapy devices. The system uses the outside housing or shell of the plug and socket to form multiple spring contacts providing the low resistance (e.g. less than 200 mohms) required. The braided shield of the cable provides a low resistance path between the connector shells on either end of the cable. The multiple spring contacts are formed in several rows to maximize use of the connector surface area.

Power Sequencing

To prevent sparking (as described above), mechanical pin sequencing by staggering the engagement point of respective contacts is used according to the present invention. In such a system the shield is connected first, then a ground pin is connected, next other pins including power and communications (e.g. network) signals are connected, and the last pin to connect is advantageously a pin carrying a signal used to initiate a power-up sequence. Circuitry connected to a low-power power supply monitors the power-up signal pin. When the power-up initiating signal is received by the monitoring circuitry, indicating that the plug is properly plugged into the socket, that circuitry sends a power-up signal to the main power load, conditioning it to turn on and connect to the medical device network system.

Before the pin carrying the power-up signal makes contact, the main, high-power power supply is turned off. When the pin carrying the power-up signal makes contact (after all other power and signal carrying pins are connected), the main, high-power power supply is turned on. Because the power-up signal is monitored by low-power circuitry, both ESD sparking and sparking produced by the connection of high-power signals as the two connector halves are plugged together are prevented.

The connector system providing at least two groups of signals isolated from each other and advantageously employs pin staggering in 3 dimensions to allow miniaturization of the isolated groups. This ensures sequencing even if a connector is not engaged in a parallel manner.

Mechanical Latching

Once the power up sequence pin has made contact, a mechanical latch engages in the side of the connector to lock the connector in place. These latches needs to be squeezed together in order to unlock the connector halves. This prevents the cable from accidentally being disconnected. These latches have been advantageously optimized to take as little room as possible on the sides of the connector while providing an easy way to grab the connector to unplug it. The latches have also been optimized to take little room in the housing of the connector shell as well as allowing connector to be placed as close as possible next to each other while being able to access the latching mechanism.

Creepage Distance Techniques

The system according to the present invention also provides for multiple isolations within the connector and cable. Because network connections that leave the patients room need to be isolated from the medical equipment, the connector system of the present invention provides the necessary creepage distances to provide for this isolation. The cable system of the present invention also includes a secondary link that is isolated from the rest of the system cable to allow for connections to non medical devices. Therefore, three isolation systems are advantageously provided for in the cable system with connector: (a) isolation for a network connection to equipment outside of the patient's room; (b) isolation for an internal network connection to non medical equipment; and (c) isolation for power and control signals.

These three isolation systems are provided by staggering the connecting pins in three dimensions. In a first dimension, dielectric, i.e. plastic, walls are used to surround groups of pins to provide isolation between the pin connections. Plastic fins are used in second dimension to add creepage distance to the pins as they are soldered to a circuit board. The fins protrude through slots in the board to provide the proper isolation. The pins are also staggered front to back in the connector to provide isolation within the connector.

Figure 1B:
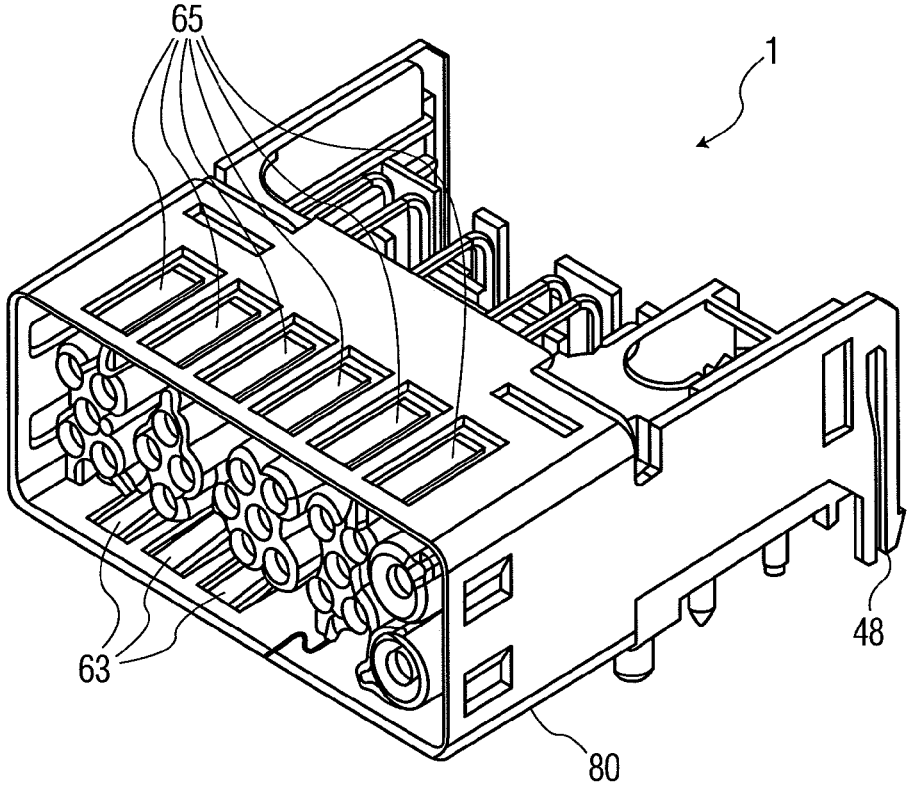
FIG. 1*b* is an isometric view, of a system connector according to principles of the present invention.

FIG. 1*a* shows a front view of a system connector 1 and FIG. 1*b* shows an isometric view of the system connector 1. The system connector 1 supports a plurality of 5 clusters 10, 20, 25, 27 and 30 of electrically isolated pins. The pins are embedded in electrical insulation providing physical separation between the pins. A first cluster 10 comprises a plurality of 5 pins and includes 2 pairs of Ethernet contact pins and a ground shield pin. A second cluster 20 includes a plurality of 4 pins including 2 pairs of communication contact pins e.g. RS232 or Ethernet without an additional ground contact. A third cluster 25 comprises a plurality of 6 pins. A fourth cluster 27 comprises a plurality of 5 pins. A fifth cluster 30 comprises a cluster of two pins. The first, second, third, fourth and fifth clusters are mutually isolated by a minimum creepage distance.

The connector body 1 provides the mutual isolation and minimum electrical creepage distance between the first, second, third, fourth and fifth clusters by physical separation and electrical insulation. Physical separation comprises a first separation distance between the first cluster 10 at one end of the connector 1, and the second cluster 20 adjacent to the first cluster 10; between the second cluster 20 and the third cluster 25 adjacent to the second cluster 20, and so forth. The electrical insulation provides the physical insulating barrier between the clusters.

More specifically, in the illustrated embodiment, as illustrated in FIG. 1*a*, a minimum of 4 millimeters (mm) of creepage distance is formed between connectors in the first cluster 10 and the second cluster 20 and between the second cluster 20 and the third cluster 25 (and other electrical pins). Plastic fins 33 facilitate ensuring that the minimum of 4 mm creepage distance is maintained between conductors related to the first cluster 10 and the second cluster 20; between the second cluster 25 and the third cluster 27, and so forth. The corresponding mating connector and the attached cable are fabricated to maintain this minimum 4 mm creepage distance.

The connector 1 further includes a metal connector housing 80 for housing and at least partially shielding the plurality of clusters 10, 20, 25, 27 and 30. The metal connector includes integral contacts 48 which may be electrically connected to a shield potential. In the illustrated embodiment, the integral contacts 48 are a homogeneous part of the metal connector housing 80. The integral contacts 48 are fabricated for direct insertion into a printed circuit (PC) board. More specifically, in the illustrated embodiment, the integral contacts 48 are directly solderable to the PC board. In addition, ground fingers 40, 42, 44 and 48 are solderable to a PC board. This permits electrical connection of the metal connector housing to the shield potential with low resistance. As used herein, low resistance means a resistance of less than 0.1 ohms. The PC board is also fabricated to maintain the minimum electrical creepage distance, in the same manner as the mating connector and the electrical cable described above.

Figure 2:
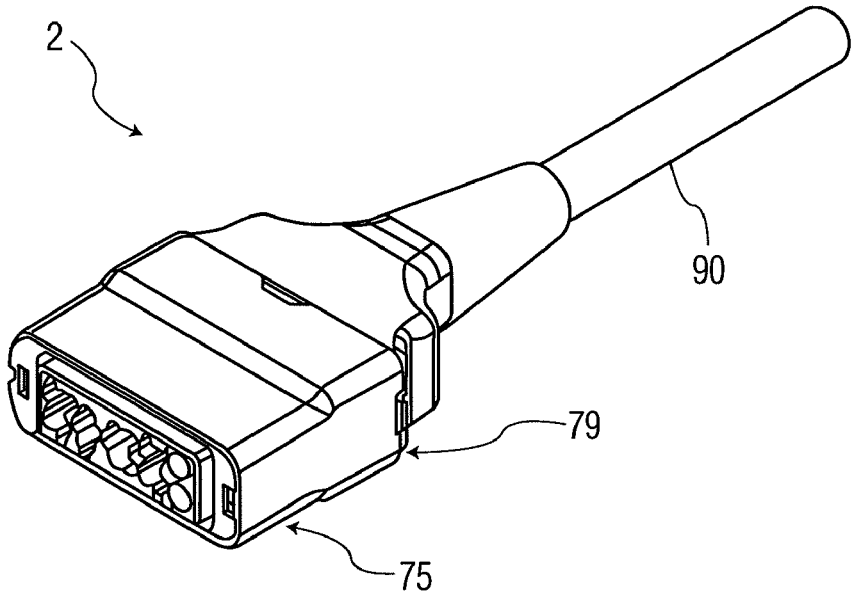
FIG. 2 is an isometric view of a mating connector according to principles of the present invention, corresponding to the connector illustrated in FIG. 1.

Referring to FIG. 2, the connector body 1 (FIG. 1) supports mating with a corresponding mating connector 2 attached to an electrical cable 90. A corresponding connector (not shown) is attached to the other end (not shown) of the cable 90. The cable 90 includes a shield and/or shielding braid. The corresponding mating connector 2 includes corresponding clusters of pins which correspond to the clusters in the connector 1. Operation of the pins during connection and disconnection is described below. The corresponding mating connector 2 includes a metal housing or shell 75. The mating connector metal housing or shell at least partially electrically shields the plurality of clusters of pins and is electrically connected to a shield potential when mated. The mating connector 2 metal housing or shell 75 in the corresponding mating connector 2 makes a relatively low resistance connection to: (a) the shield and/or (b) the shielding braid, of the electrical cable 90 attached to the corresponding mating connector 2. The corresponding mating connector 2 also includes quick connect mechanical latches which are activated by an unlocking ring 79.

The metal connector housing 80 (FIG. 1*b*) includes contacts 63 and 65 (representing a plurality of metal fingers) that form a relatively low resistance connection to the metal housing or shell 75 of the corresponding mating connector 2. The metal housing 80 contacts 63, 65 to the corresponding mating connector 2 housing or shell 75 comprise: (a) a spring contact, and/or a spring metal finger. In particular, the metal connector housing 80 contacts 63, 65 may be a homogenous part of the metal connector housing 80. In the illustrated embodiment, the metal housing 80 contacts 63, 65 are metal fingers 63, 65, representing one or more metal fingers fabricated homogenously in the metal housing 80.

Figure 3:
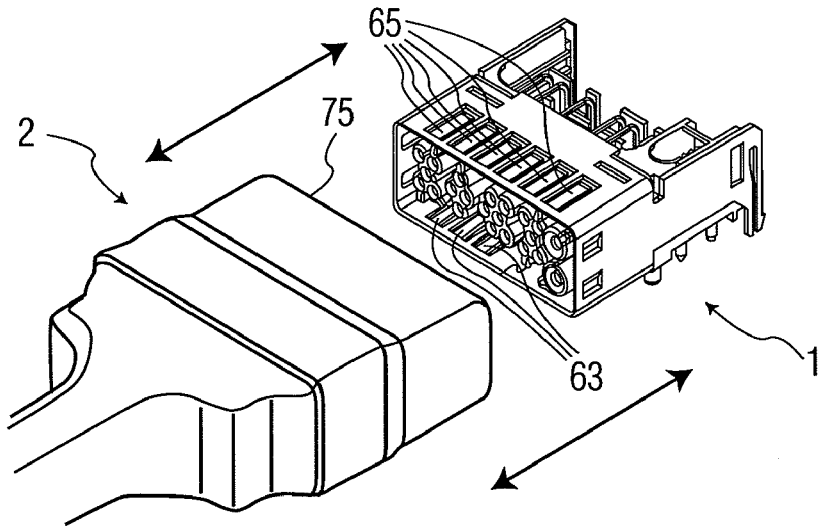
FIG. 3 is an isometric view illustrating how the mating connector of FIG. 2 plugs into the connector of FIG. 1 according to principles of the present invention.

Referring to FIG. 3, when the connector 1 and connector 2 are connected as illustrated by the arrows, the metal fingers 63, 65 make an electrical pressure contact with the metal housing or shell 75 of the mating connector 2 (FIG. 2). In this manner mating connector 2 makes a relatively low resistance connection to the shield and/or the shielding braid, as described above.

When the cable 90, with associated mating connectors 2 at both ends, is connected to corresponding connectors 1 on respective medical devices, the metal shield of a first device is connected to the housing 80 of the connector 1 on the first device. The housing 80, in turn, is connected to the metal housing or shell 75 of the corresponding mating connector 2 plugged into the first medical device. The metal housing or shell 75 of that mating connector 2 is connected to the shield or shielding braid of the cable 90. At the other end of the cable 90, the shield or shielding braid is connected to the metal housing or shell 75 of the associated mating connector 2. The metal housing or shell of that mating connector is connected to the metal housing 80 of the connector 2 at the second medical device. The metal housing 80 of the connector 2 at the second medical device is connected to the metal housing of the second medical device. In this manner, the metal housing of the first and second medical devices are connected by a relatively low resistance conductive path, and are thus maintained at substantially the same potential. This minimizes the possibility of a patient coming in contact concurrently with metal housings of medical devices which are at different potentials, eliminating the possibility of current passing through he patient.

The first cluster 10 and the second cluster 20 individually convey a plurality of independent electrical communications links. At least one of them convey a ground signal. In the illustrated embodiment, the first cluster 10 includes pins providing a first communications link. The second cluster 20 includes pins providing a second communications link independent of the first communications link. The first cluster 10 and second cluster 20, thus, convey first and second corresponding independent electrical communications link. The first and second corresponding independent electrical communications links employ communications protocols which are compatible with: (a) the IEEE Ethernet standard, (b) a Bluetooth standard, (c) the RS232 standard, and/or an IP protocol standard. In the illustrated embodiment, the communications link in the first cluster 10 is an Ethernet link and the communications link in the second cluster 20 is either a separate Ethernet or RS232 communications link At least one of the independent electrical communications links, either the first communication link carried by the first cluster 10 or the second communications link carried by the second cluster 20, convey a patient monitoring signal. This signal may be generated by the medical monitoring and/or therapy device connected to the patient. The patient monitoring signal may be an alarm signal to indicate that a physiological parameter is out-of-range, or a patient vital signal representative signal, such as a temperature signal, blood pressure signal, $SpO_2$ signal, etc. These signals are communicated to other medical devices in the network, which may include other medical monitoring and/or therapy devices connected to the patient, central storage devices, such as hospital databases storing the vital signal data, and/or central monitoring stations where one person may monitor the vital sign data from a plurality of patients.

Figure 4:
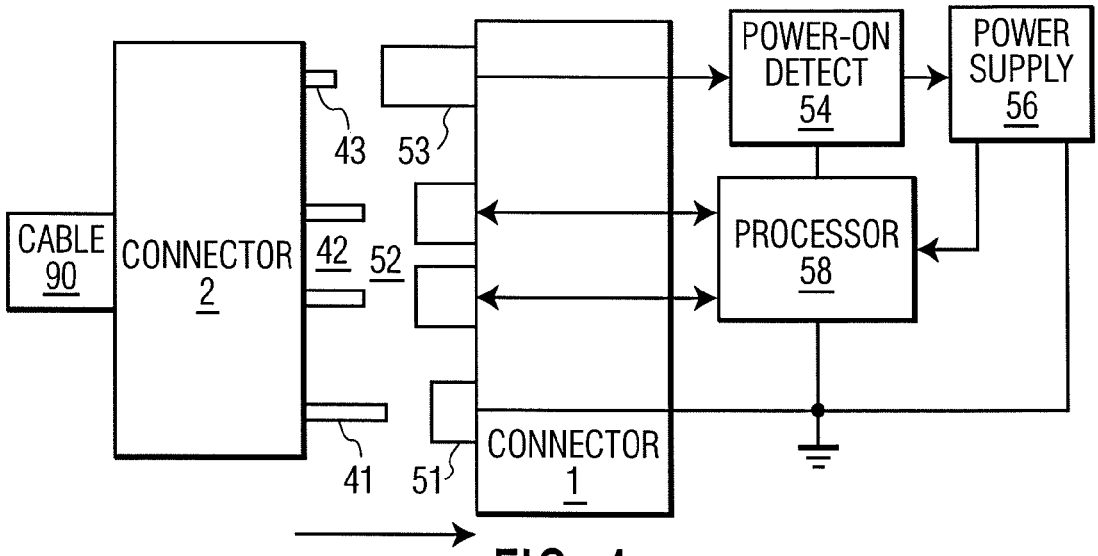
FIG. 4 is a diagram illustrating schematically the power-on sequencing according to principles of the present invention, when the mating connector of FIG. 2 plugs into the connector of FIG. 1.

FIG. 4 illustrates the operation of the power sequencing feature of the present invention. In FIG. 4, a representative number of pins on the connectors 1 and 2 are represented by rectangles. In particular in FIG. 4, pins are illustrated on connector 2 and sockets on connector 1, though one skilled in the art understands that pins may be placed on connector 1 and sockets on connector 2; or a combination of pins and sockets on both connectors 1 and 2. In order to simplify the drawing, no attempt is made to represent clusters and the drawing is schematic only, and not intended to be representational or to scale.

In general pins of the plurality of clusters 10, 20, 25, 27 30 (FIG. 1) are staggered and in response to mating with the corresponding connector, a first pin makes electrical contact before a different second pin and the second pin makes electrical contact before a different third pin. More specifically, in the illustrated embodiment, when connector 2 is plugged into connector 1, a first pin 41 makes electrical contact with corresponding first socket 51 before any other pins make electrical contact. This pin is coupled to a source of reference potential (ground). Then a second pin, or set of pins 42 make electrical contact with corresponding socket or set of sockets 52. Then a third pin 43 makes electrical contact with a corresponding third socket 53. The first socket 51 is coupled to ground connections of a power-on detector 54, power supply 56 and a processor 58. Socket or set of sockets 52 are coupled to bidirectional data terminals of the processor 58. Socket 53 is coupled to an input terminal of the power-on detector 54. An output terminal of the power-on detector 54 is coupled to a control input terminal of the power supply 56. A power output terminal of the power supply 56 is coupled to the processor 58.

In operation, the power-on detector 54 receives power from a low-power power supply (not shown). It detects the presence of a power-on signal at its input terminal. If the power-on signal is not detected it provides a control signal to the power supply 56 conditioning it to remain in the powered-down condition. As the connector 2 is plugged into the connector 1, as indicated by the arrow, the first pin 41 and socket 51 make electrical contact, connecting ground signals. Then the second pin or set of pins 42 and socket or set of sockets 52 make electrical contact, connecting power and/or data conductors. Then the third pin 43 and socket 53 make electrical contact. The socket 53 carries a power-on signal. This power-on signal is detected by a power-on detector circuit 54. In response to detection of the power-on signal, the power-on detector provides a control signal to the power supply 56 conditioning it to power-on and provide power to the processor 58, and other circuitry (not shown) in the network, possibly through conductors in the cable 90.

When being unplugged, the first pin to disconnect from it socket is pin 43 from socket 53. The power-on detector 54 detects the absence of a power-on signal and conditions the power supply 56 to power-down. Then the pin or set of pins 42 disconnect from the socket or set of sockets 52 and finally the pin 41 disconnects from the socket 51. In this manner, relatively high power is not applied to the medical device or communications cable 90 until the connectors 1 and 2 are being connected or disconnected. This minimizes the risk of sparking during the connection or disconnection process.

Figure 5:
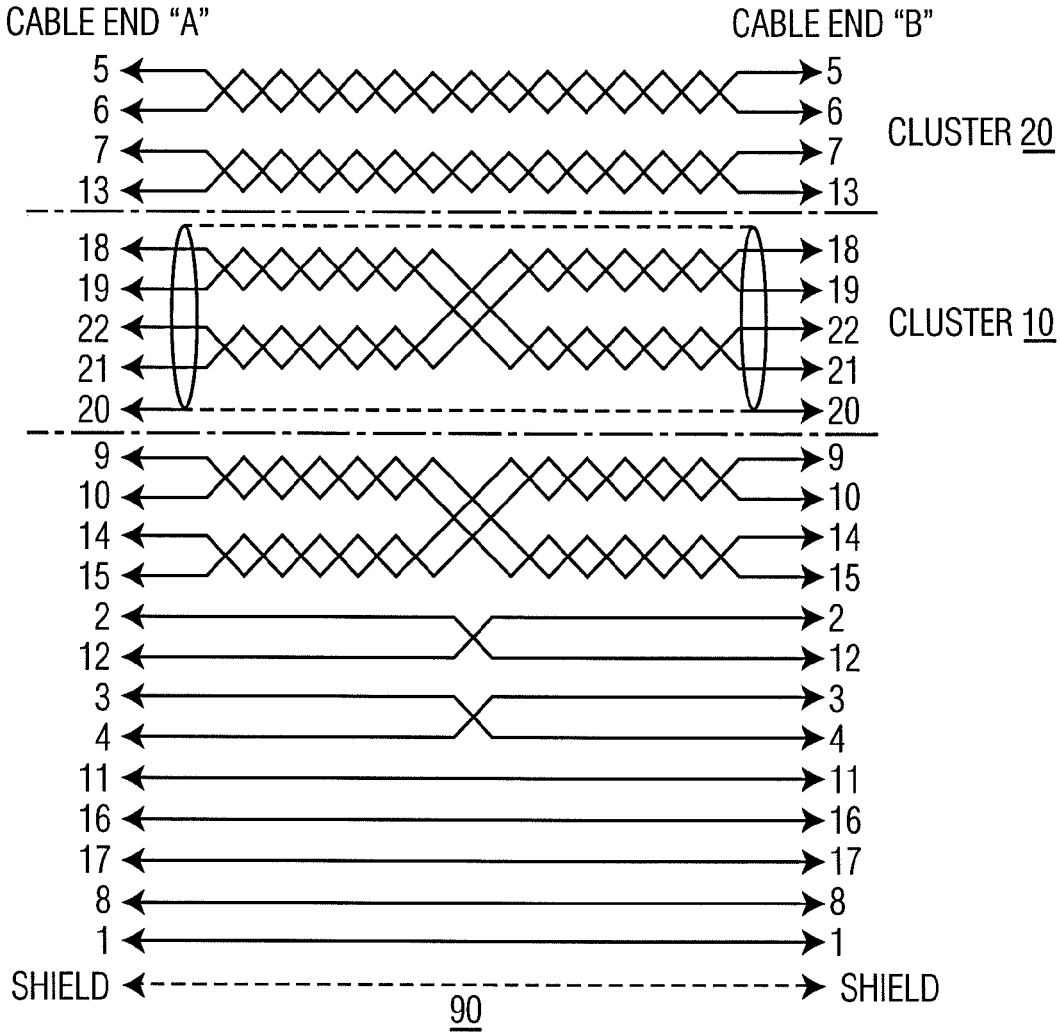
FIG. 5 is a wiring diagram of a cable interconnecting mating connectors of FIG. 2 according to principles of the present invention.

FIG. 5 illustrates the wiring within the cable 90 (FIG. 2). Cluster 10 (FIG. 1) is connected to two twisted pairs with a shield. These twisted pairs are cross-coupled within the cable so that a transmitting pair in one medical device is connected to a receiver in the other medical device and visa versa. Cluster 20 includes two unshielded twisted pairs. Other clusters may include other cross-connected twisted pairs, cross-connected single conductors, and other conductors carrying signals and/or power. As described above, the cable 90 has a shield or braided shield which is connected to the metal housing of the medical devices at both ends of the cable 90.

The system described above advantageously achieves ground integrity between a central processing device (e.g., a workstation or PC) and medical devices (e.g., patient parameter acquisition devices such as an EKG system) using a cable 90 (FIG. 2) including connectors 2 with a quick disconnect mechanical latch 79. The grounding system supports a modular system where individual medical devices of the system "float" to the potential of the central processing device (a central hub) by using dc to dc converters in each of the individual medical devices. The central processing device uses power and signal I/O that is grounded to the central processing device chassis and from there to a low impedance "medical ground" even in patient vicinity. Thereby advantageously a normal PC may be used as a central processing device without requiring expensive customized isolating DC-DC converters and opto-isolators or magnetic signal isolators for conveying signal and power between the central processing device and the individual medical devices.

Figure 6:
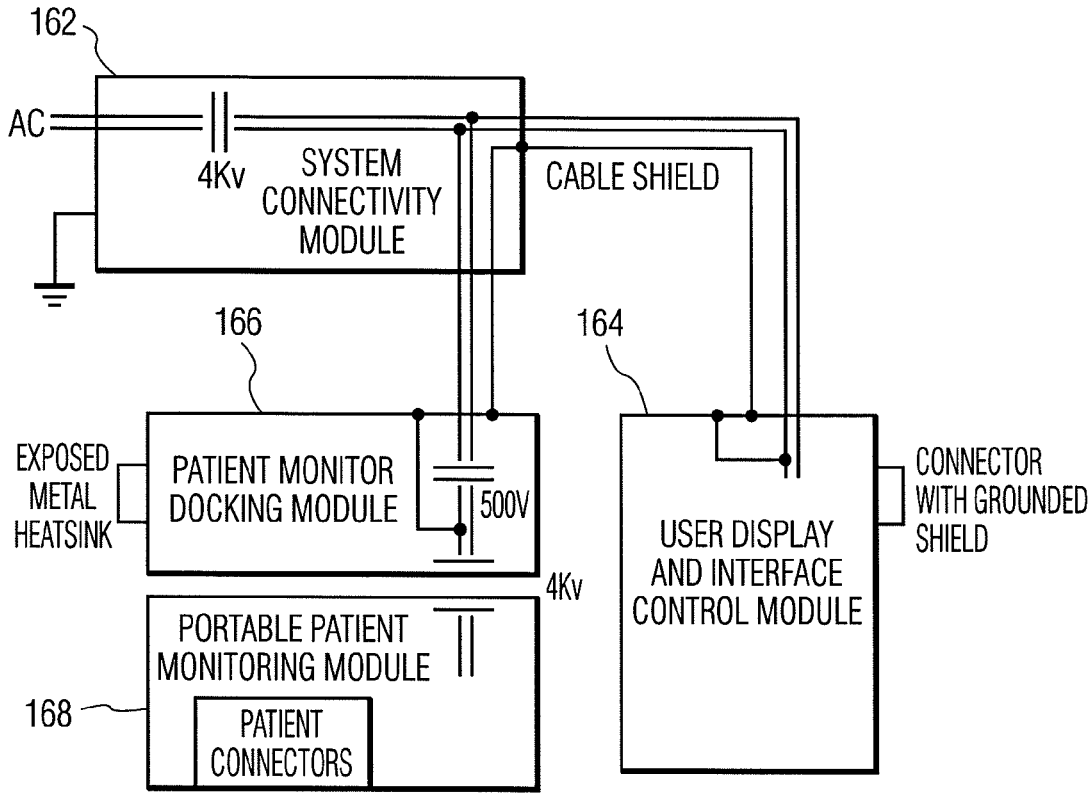
FIGS. 6, 7 and 8 are block diagrams illustrating isolation schemes which may be arranged using the cable system according to principles of the present invention.
Figure 7:
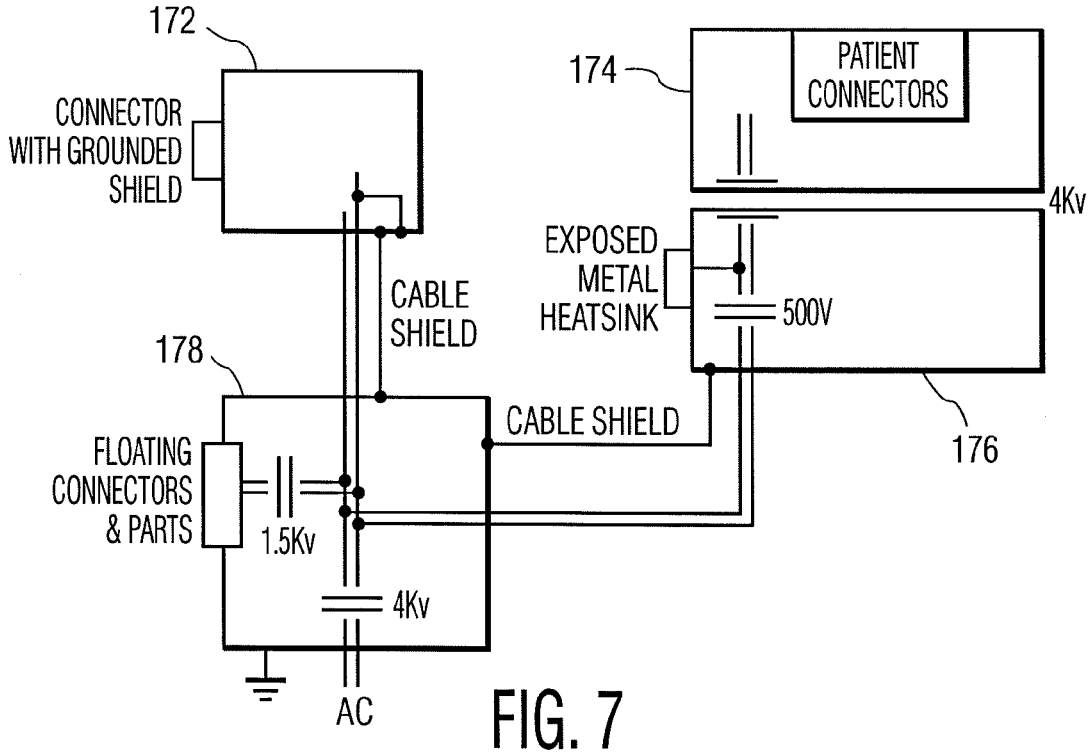
Figure 8:
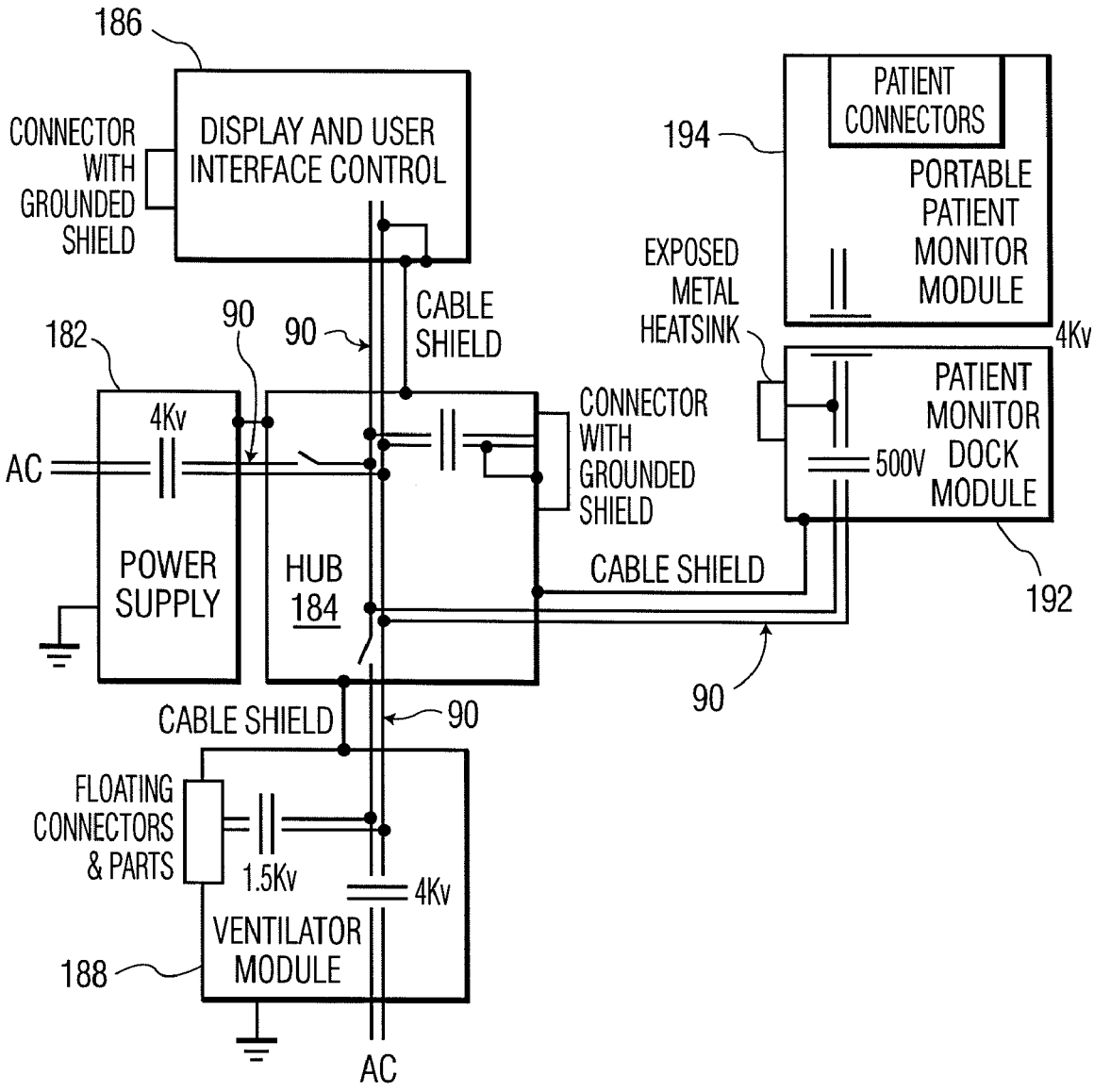

FIGS. 6, 7 and 8 illustrate advantageous grounding configurations between a central device and medical devices. In FIG. 6, a system connectivity module 162 operates as a central device and is illustrated as being coupled to a display and user interface control module 164 and a patient monitor docking module 166. One skilled in the art understands that more than one display and user interface module 164 (not shown) and more than one patient monitor docking module 166 (not shown) may be concurrently coupled to the system connectivity module 162. The system connectivity module 162 is illustrated as being coupled to the AC mains for receiving power, and provides electrical isolation from the AC mains supply of 4 kilovolts (Kv). The metal housing of the system connectivity module provides the reference potential (ground). The system connectively module 162 includes one or more sockets 1 as illustrated in FIGS. 1 and 4 providing minimum creepage distance, power-on sequencing and metal housing interconnection as described above.

The user display and interface control module 164 displays patient medical data and provides to a user access to a user interface for viewing and interacting with that data. The display and user interface control module 164 includes a socket 1 as illustrated in FIGS. 1 and 4. The patient monitor docking module 166 is coupleable to a portable patient monitoring module 168. The portable patient monitoring module 168 includes connectors for connecting to electrodes and/or electrical equipment attached to the patient. Wireless connections communicate data between the portable patient monitoring module 168 and the patient monitor docking module 166.

Respective cables 90, wired as illustrated in FIG. 5 and with connectors 2 on the ends as illustrated in FIGS. 2 and 4 (not shown in FIG. 6 to simplify the figure), interconnect the display and user interface control module 164 and the system connectivity module 162, and interconnect the patient monitor docking module 166 and the system connectivity module 162. As may be seen in FIG. 6, the shield or shield braid of the cable 90 interconnects the metal housings of the system connectivity module 162, the display and user interface control module 164 and the patient monitor docking module 166, so they all are maintained at ground potential. The arrangement of FIG. 6 provides for interconnecting a plurality of display modules and patient monitoring modules to a central device, possibly at a remote location.

In FIG. 7, a point-of-care ventilator module 178 operates as a central device. The ventilator module 178 is a patient therapy device, and provides breathing assistance to a patient. The ventilator module 178 also monitors patient physiological parameters related to breathing, such as breath rate, inspiration volume, and so forth. The ventilator module 178 is connected to the AC mains and provides 4 Kv isolation from the AC mains. The metal housing of the ventilator module 178 provides the ground potential. The ventilator module 178 includes one or more sockets 1 as illustrated in FIGS. 1 and 4. The ventilator module 178 is coupled to a display and user interface control module 172 and a patient monitor dock module 176, which in turn is coupleable to a portable patient monitor module 174. The display and user interface module 172 and patient monitor dock module 176 are similar to the corresponding modules in FIG. 6 and they are not described in detail here.

Respective cables 90, wired as illustrated in FIG. 5 and with connectors 2 on the ends as illustrated in FIGS. 2 and 4 (not shown in FIG. 7 to simplify the figure), interconnect the ventilator module 178 with the display and user interface control module 172 and the patient monitor docking module 176. As may be seen in FIG. 7, the shield or shield braid of the cable 90 interconnects the metal housings of the ventilator module 178, the user display and interface control module 172 and the patient monitor docking module 176, so they all are maintained at ground potential. The arrangement illustrated in FIG. 7 permits a plurality of display modules and monitoring modules to be interconnected to a central device providing therapy to a patient. This arrangement may be implemented within a patient room.

In FIG. 8, a power supply 182 is coupled to AC mains and provides 4 Kv isolation from the AC mains. The power supply 182 includes at least one connector 1 as illustrated in FIGS. 1 and 4 and provides power for the remaining devices. A central hub 184 includes a plurality of connectors 1, as illustrated in FIGS. 1 and 4. The hub 184 is coupled to the power supply 182, and to a display and user interface control module 186, a ventilator module 188, and a patient monitor dock module 192, which in turn is coupleable to a portable patient monitor module 194. The display and user interface control module 186, the patient monitor docking module 192, and the portable patient monitor module 194 are similar to the corresponding modules in FIGS. 6 and 7; and the ventilator module 188 is similar to the ventilator module 178 of FIG. 7. They are not described in detail here.

Respective cables 90, wired as illustrated in FIG. 5 and with connectors 2 on the ends as illustrated in FIGS. 2 and 4 (not shown in FIG. 8 to simplify the figure), interconnect the power supply 182 and the hub 184, and interconnect the display and user interface control module 186, the ventilator module 188 and the patient monitor docking module 176 with the hub 184. As may be seen in FIG. 8, the shield or shield braid of the cable 90 interconnects the metal housings of the power supply 182, the hub 184, the display and user interface control module 186, the ventilator module 188, and the patient monitor docking module 192, so they all are maintained at ground potential. The arrangement illustrated in FIG. 8 permits a plurality of different display modules, monitoring modules and therapy modules to be interconnected to a central hub. This arrangement may be implemented within, for example, an operating room or emergency room where a wider variety of medical devices are used concurrently, and allows a larger number and different combination of medical devices to be interconnected via the hub. The hub may also provide a connection to a central location.

A connector system according to the present invention, as described above, forms a practical method for connecting and disconnecting modular pieces of a large medical device workstation. The connector 1 (FIG. 1) provides a controlled way to make the necessary electrical connections of a system cable 90 (FIG. 2) while providing the required medical isolation. It also allows the central control element of this type of system to be a standard PC. Any system of instruments which would benefit from multiple isolations with controlled power sequencing may employ the system.

The system advantageously enables use of a standard PC as a control element by floating the chassis of other devices in the network to its potential. The system also advantageously provides three dimensional staggering of pins together with plastic walls to shrink the footprint of connector with this type of isolation and staggering of pins to ensure a sparkless connection. A mechanical latching mechanism also allows connectors to be mounted as close as possible while taking up little room in the connector housing. The system provides a primary method of interconnection of medical equipment including monitoring and therapy products.

What is claimed is:

1. A connector system for safely connecting and disconnecting medical monitoring/treatment devices, comprising:

a first connector with a connector housing and a plurality of contacts grouped in clusters, wherein the contacts in each cluster have substantially identical length and contacts are staggered between different clusters, said clusters being isolated from one another by a minimum electrical creepage distance, and a second connector configured to mate with the first connector and having corresponding contacts grouped in mating clusters, with the contacts of different mating clusters configured to sequentially contact the corresponding contacts in response to mating with the first connector, said mated first and second connector maintaining the minimum electrical creepage distance, the second connector further comprising an electrically conductive housing or shell configured to make a relatively low resistance connection to a housing contact of the connector housing of the first connector, thereby ensuring sparkless connection and disconnection of the connector to/from the corresponding connector.

2. The system according to claim 1, wherein the electrically conductive housing or shell of the second connector makes a relatively low resistance connection to at least one of (a) a shield and (b) a shielding braid of an electrical cable attached to the second connector.

3. The system according to claim 1, wherein the electrically conducting housing or shell of the second connector at least partially electrically shields the clusters of mating contacts and is electrically connected to a shield potential.

4. The system according to claim 1, wherein the contacts of the first connector are implemented as pins or sockets, or a combination thereof, and the contacts of the second connector are implemented as sockets or pins mating with the pins or sockets of the first connector.

5. The system according to claim 1, wherein the connector housing of the first connector at least partially electrically shields the contacts grouped in the clusters and includes an integral contact for direct insertion into a PC board and low-resistance electrical connection to a shield potential.

6. The system according to claim 5, wherein said integral contact is directly solderable to said PC board.

7. The system according to claim 5, wherein said integral contact is a homogenous part of said connector housing.

8. The system according to claim 5, wherein the housing contact of the first connector comprises at least one of (a) spring contact and (b) a spring metal finger.

9. The system according to claim 5, wherein the housing contact of the first connector is a homogenous part of the connector housing.

10. The system according to claim 1, wherein contacts of different clusters convey separate electrical communication links.

11. The system according to claim 10, wherein at least one of the clusters conveys a ground signal.

12. The system according to claim 10, wherein at least one of the separate electrical communication links conveys a patient monitoring signal.

13. The system according to claim 12, wherein the patient monitoring signal is at least one of (a) an alarm signal and (b) a patient vital sign representative signal.

* * * * *

UNITED STATES PATENT AND TRADEMARK OFFICE

CERTIFICATE OF CORRECTION

PATENT NO. : 7,497,731 B2
APPLICATION NO. : 11/562737
DATED : March 3, 2009
INVENTOR(S) : Rosenfeldt et al.

It is certified that error appears in the above-identified patent and that said Letters Patent is hereby corrected as shown below:

On the front page, item (75) under "Inventors", delete "Clifford Richer-Kelly" and insert --Clifford Risher-Kelly--.

Signed and Sealed this

Fourteenth Day of December, 2010

David J. Kappos

David J. Kappos
*Director of the United States Patent and Trademark Office*